US010566746B1

(12) United States Patent
Breeden et al.

(10) Patent No.: US 10,566,746 B1
(45) Date of Patent: Feb. 18, 2020

(54) ILLUMINATED ELECTRICITY DISTRIBUTION DEVICE

(71) Applicants: George Breeden, Sarasota, FL (US); Daniel Termaat, Sarasota, FL (US)

(72) Inventors: George Breeden, Sarasota, FL (US); Daniel Termaat, Sarasota, FL (US)

( * ) Notice: Subject to any disclaimer, the term of this patent is extended or adjusted under 35 U.S.C. 154(b) by 0 days.

(21) Appl. No.: 16/260,284

(22) Filed: Jan. 29, 2019

(51) Int. Cl.
*H01R 13/717* (2006.01)
*H01R 25/00* (2006.01)
*H01R 13/70* (2006.01)
*H01R 24/78* (2011.01)

(52) U.S. Cl.
CPC ..... *H01R 13/7175* (2013.01); *H01R 13/70* (2013.01); *H01R 24/78* (2013.01); *H01R 25/003* (2013.01); *H01R 25/006* (2013.01)

(58) Field of Classification Search
CPC ..... H01R 25/003; H01R 13/717
See application file for complete search history.

(56) References Cited

U.S. PATENT DOCUMENTS 3,061,716 A * 10/1962 Benander ..... H05B 33/06 362/641
3,588,489 A * 6/1971 Gaines ..... H01R 13/717 362/95
3,895,225 A * 7/1975 Prior ..... F21S 8/00 362/95
4,000,405 A * 12/1976 Horwinski ..... F21S 8/035 362/95
4,113,334 A * 9/1978 Instone ..... H01R 25/003 439/96
4,215,277 A * 7/1980 Weiner ..... H05B 37/029 307/115
4,493,515 A * 1/1985 Banks ..... H01R 25/003 29/860
4,717,350 A * 1/1988 Lax ..... H01R 25/003 439/488
4,774,641 A * 9/1988 Rice ..... F21S 8/035 174/66
4,867,701 A * 9/1989 Wiand ..... H01R 25/006 439/501

(Continued)

FOREIGN PATENT DOCUMENTS

CA 2655038 8/2009

*Primary Examiner* — Ross N Gushi

(57) ABSTRACT

The illuminated electricity distribution device is an electricity distribution device. The illuminated electricity distribution device distributes AC electrical energy suitable for use with an appliance. The illuminated electricity distribution device is a lamp. The illuminated electricity distribution device is configured to mount on a surface including the inferior side of horizontal surface. The illuminated electricity distribution device comprises a housing, a power distribution circuit, and a lighting circuit. The housing contains the power distribution circuit and the lighting circuit. The power distribution circuit receives electricity from an external power source and distributes the received electricity to the appliance. The external power source is selected from the group consisting of the national electric grid or an additional instantiation of the illuminated electricity distribution device. The lighting circuit generates light used to illuminate the space around the illuminated electricity distribution device.

13 Claims, 6 Drawing Sheets

(56) References Cited

U.S. PATENT DOCUMENTS 4,875,878 A * 10/1989 Meyer ..... B65H 75/362 439/501
4,930,047 A * 5/1990 Peterson ..... H01R 25/003 200/51 R
5,057,039 A * 10/1991 Persing ..... A47B 21/06 248/231.71
5,071,367 A * 12/1991 Luu ..... H01R 13/72 191/12.4
5,077,484 A * 12/1991 Tsai ..... H01R 13/70 307/117
5,230,552 A * 7/1993 Schipper ..... A47B 21/06 108/26
5,272,587 A * 12/1993 Wan ..... H01R 13/6666 361/111
5,277,620 A * 1/1994 Taylor ..... H01R 13/717 439/372
5,351,173 A * 9/1994 Byrne ..... A47B 21/06 362/127
5,452,807 A * 9/1995 Foster ..... A61G 13/107 211/168
5,481,442 A * 1/1996 Dickie ..... F21S 8/035 362/290
5,516,298 A * 5/1996 Smith ..... A47B 21/06 439/131
5,544,025 A * 8/1996 Bohlool ..... F21S 8/035 362/249.01
5,562,488 A * 10/1996 Neiser ..... H01R 13/514 439/373
5,579,201 A * 11/1996 Karageozian ..... G06F 1/266 307/38
5,582,522 A * 12/1996 Johnson ..... H01R 13/514 439/214
5,670,776 A * 9/1997 Rothbaum ..... F21S 8/035 250/214 AL
5,708,554 A * 1/1998 Liner ..... H01R 13/68 340/639
5,721,934 A * 2/1998 Scheurich ..... G06F 1/26 713/320
5,738,548 A * 4/1998 Rutulante ..... H01R 13/72 439/4
5,780,775 A * 7/1998 Yu ..... H01R 13/506 174/135
5,788,521 A * 8/1998 Milan ..... H01R 13/514 439/101
5,816,682 A * 10/1998 Marischen ..... F21S 8/035 362/84
5,899,761 A * 5/1999 Crane ..... H01R 25/00 439/142
5,906,517 A * 5/1999 Crane ..... H01R 25/00 439/654
5,954,525 A * 9/1999 Siegal ..... A47B 21/06 312/223.6
5,964,618 A * 10/1999 McCarthy ..... H01R 13/6666 439/535
6,004,157 A * 12/1999 Glass ..... A47B 21/06 439/535
6,024,588 A * 2/2000 Hsu ..... H01R 31/02 439/173
6,024,599 A * 2/2000 Stathis ..... H01R 13/60 174/480
6,028,267 A * 2/2000 Byrne ..... H01R 13/518 174/55
6,042,426 A * 3/2000 Byrne ..... H01R 25/00 439/131
6,077,109 A * 6/2000 Prazoff ..... H01R 13/72 191/12.4
6,085,667 A * 7/2000 Gevaert ..... A47B 21/06 108/50.02
6,086,397 A * 7/2000 Chapman ..... H01R 25/003 439/214
6,132,257 A * 10/2000 Wang ..... H01R 13/641 337/142
6,179,665 B1 * 1/2001 Rossman ..... H01R 13/72 439/131
6,190,017 B1 * 2/2001 Lai ..... F21S 8/035 362/659
6,211,581 B1 * 4/2001 Farrant ..... G06F 1/266 307/115
6,229,691 B1 * 5/2001 Tanzer ..... H01R 25/006 361/610
6,234,812 B1 * 5/2001 Ivers ..... A47B 21/06 362/127
D445,403 S 7/2001 Veino
6,254,427 B1 * 7/2001 Stathis ..... H01R 13/60 312/223.6
6,273,578 B1 * 8/2001 Lai ..... F21V 21/0824 174/58
6,290,518 B1 * 9/2001 Byrne ..... H02G 3/185 16/224
6,315,604 B1 * 11/2001 Lee ..... H01R 13/516 439/535
6,379,182 B1 * 4/2002 Byrne ..... H01R 13/73 439/574
6,443,772 B1 * 9/2002 Chen ..... H01R 25/003 200/51.02
6,454,609 B1 * 9/2002 Huang ..... H01R 13/70 439/214
6,474,829 B2 * 11/2002 Clodfelter ..... F21S 8/035 362/198
6,476,523 B1 * 11/2002 Lee ..... H01R 13/70 307/141
6,486,407 B1 * 11/2002 Hawker ..... H01R 31/02 174/149 B
6,512,309 B2 1/2003 Stekelenburg
6,540,554 B2 * 4/2003 McCarthy ..... H01R 13/73 439/574
6,547,411 B1 * 4/2003 Dornbusch ..... F21S 8/035 362/276
6,573,617 B2 * 6/2003 Jones ..... H01R 13/514 307/11
6,589,073 B2 * 7/2003 Lee ..... H01R 13/516 439/535
6,642,450 B1 * 11/2003 Hsiao ..... H01R 25/006 174/480
6,666,712 B1 * 12/2003 Kramer ..... G06F 1/266 439/501
6,676,274 B1 * 1/2004 Rafferty ..... F21S 8/035 362/276
6,717,053 B2 * 4/2004 Rupert ..... H02G 3/14 174/53
6,731,024 B1 * 5/2004 Molnar ..... H01R 13/6666 307/116
6,793,523 B1 * 9/2004 Wei ..... H01R 13/72 439/501
6,805,581 B2 * 10/2004 Love ..... H01R 13/447 439/367
6,811,281 B1 * 11/2004 Hsiao ..... F21S 8/035 362/401
6,836,402 B1 * 12/2004 Huang ..... H01R 13/465 174/50
6,857,760 B2 * 2/2005 Chien ..... F21V 33/006 362/396
6,875,051 B2 * 4/2005 Pizak ..... H01R 25/003 439/501
6,883,927 B2 * 4/2005 Cunningham ..... A47L 5/38
6,885,796 B2 * 4/2005 Lubkert ..... G06F 1/266 312/223.3
6,897,379 B1 * 5/2005 Hsiao ..... H01H 9/0214 174/480
6,908,334 B2 * 6/2005 Huang ..... H01R 13/465 439/491
6,940,015 B2 * 9/2005 Fang ..... H01R 13/465 174/50
6,991,495 B1 * 1/2006 Aromin ..... H01H 83/14 361/42
6,995,525 B2 * 2/2006 Barthelmess ..... H05B 37/029 315/152

(56) References Cited

U.S. PATENT DOCUMENTS 7,001,211 B2 * 2/2006 Lichtscheidl ..... H01R 25/003 439/131
7,004,595 B1 * 2/2006 Stoddard ..... H01R 13/6641 362/114
7,004,786 B1 * 2/2006 Bloom ..... H01R 13/72 439/142
7,011,422 B2 * 3/2006 Robertson ..... F21V 33/006 200/310
7,036,948 B1 * 5/2006 Wyatt ..... H01R 13/6683 362/276
7,045,975 B2 * 5/2006 Evans ..... F21S 8/035 315/149
7,081,006 B2 * 7/2006 Lichtscheidl ..... H01R 25/003 439/131
7,083,421 B1 * 8/2006 Mori ..... H01R 13/46 439/574
7,101,215 B2 * 9/2006 Woellner ..... H01R 13/639 439/371
7,112,097 B1 * 9/2006 Lam ..... H01R 25/003 439/654
7,154,402 B2 * 12/2006 Dayoub ..... G08B 17/10 340/628
D535,257 S * 1/2007 Byrne ..... D13/139.4
7,156,694 B1 * 1/2007 Anderson ..... F21V 33/0012 439/110
7,163,409 B1 * 1/2007 Chen ..... H01R 25/006 439/131
7,172,456 B1 * 2/2007 Nagy ..... H01R 13/72 174/135
7,186,146 B1 * 3/2007 Chang ..... H01R 13/68 174/350
7,223,122 B2 * 5/2007 Mori ..... H01R 13/447 439/501
7,232,330 B2 * 6/2007 Woellner ..... H01R 13/639 340/656
7,239,892 B2 * 7/2007 Martin ..... H04B 3/54 455/557
7,358,625 B2 * 4/2008 Cheng ..... H01R 13/6675 307/18
7,393,250 B2 * 7/2008 Tanaka ..... H01R 25/003 439/652
7,402,060 B1 * 7/2008 Buzil ..... H01R 13/70 362/95
7,407,392 B2 * 8/2008 Cooke ..... A47B 21/06 108/62
7,442,090 B2 * 10/2008 Mori ..... H01R 25/003 174/53
7,467,971 B2 * 12/2008 Lin ..... H01R 13/60 191/12.2 R
7,488,203 B2 * 2/2009 Leddusire ..... H01R 13/567 439/535
7,511,231 B2 * 3/2009 Drane ..... H02G 3/185 174/482
7,625,241 B2 * 12/2009 Axland ..... H01R 25/006 439/640
7,626,119 B2 * 12/2009 Axland ..... H01R 25/006 174/135
7,635,273 B2 * 12/2009 Buzil ..... H01R 13/70 439/214
7,651,365 B2 * 1/2010 Chien ..... H01R 13/6691 439/490
7,663,866 B2 * 2/2010 Lee ..... H01R 13/652 307/117
7,690,942 B2 * 4/2010 Berg ..... H01R 13/465 439/488
7,726,825 B2 * 6/2010 Mandapat ..... H01R 25/003 361/118
7,731,540 B2 * 6/2010 Mori ..... H01R 25/003 439/214
7,736,033 B2 * 6/2010 Patel ..... F21S 6/002 307/43
7,736,178 B2 * 6/2010 Byrne ..... G06F 1/266 439/527
7,758,376 B2 * 7/2010 Hwang ..... H01R 13/60 191/12.4
7,790,982 B2 * 9/2010 Weeks ..... H01R 13/4534 174/50
7,815,332 B1 * 10/2010 Smith ..... F21S 8/04 362/133
7,845,974 B2 * 12/2010 Yue ..... H01R 25/003 191/12.4
7,938,679 B2 * 5/2011 Wadsworth ..... H01R 13/74 439/574
7,950,941 B1 * 5/2011 Wang ..... H01R 25/003 439/214
7,961,111 B2 * 6/2011 Tinaphong ..... H02H 9/042 340/638
8,016,611 B2 * 9/2011 Fleisig ..... H01R 13/72 439/501
8,106,541 B1 * 1/2012 Sarullo ..... H01R 25/006 307/139
8,138,430 B1 * 3/2012 Ucero ..... H02G 3/128 174/480
8,187,024 B2 * 5/2012 Williams ..... H01R 13/717 439/488
8,193,658 B2 * 6/2012 Fleisig ..... H01R 13/665 174/493
8,217,528 B2 * 7/2012 Fleisig ..... H01R 13/72 174/493
8,444,309 B2 * 5/2013 Jansen ..... H01H 9/182 362/551
8,545,039 B2 * 10/2013 Patel ..... F21S 6/002 307/43
8,605,091 B2 * 12/2013 Bradbury ..... G09G 5/00 345/30
8,686,593 B2 * 4/2014 Chang ..... H02J 9/06 307/64
8,721,124 B2 * 5/2014 Byrne ..... F21V 21/22 362/285
8,783,936 B2 * 7/2014 Chien ..... F21S 8/035 362/157
8,896,150 B1 * 11/2014 Shammoh ..... H01R 13/70 307/31
8,994,330 B2 * 3/2015 Kuo ..... H01R 25/003 320/111
9,048,040 B1 * 6/2015 Miller ..... G04C 23/04
9,054,449 B2 * 6/2015 Utz ..... H01R 13/5812
9,112,321 B2 * 8/2015 Bhosale ..... H01R 13/6658
9,148,006 B2 * 9/2015 Byrne ..... H02G 3/18
9,148,030 B1 * 9/2015 Johnson ..... H02J 7/0042
9,173,257 B2 * 10/2015 Cubias ..... H05B 33/0809
9,225,128 B2 * 12/2015 Yap ..... H01R 25/003
9,313,850 B2 * 4/2016 Zhao ..... H05B 33/0845
9,438,070 B2 * 9/2016 Byrne ..... H02J 5/005
9,484,693 B1 * 11/2016 Richter ..... G06F 1/266
9,485,830 B2 * 11/2016 Sakai ..... H05B 33/0824
9,502,832 B1 * 11/2016 Ullahkhan ..... H01R 13/7175
9,525,248 B2 * 12/2016 Chiang ..... H01R 13/6691
9,543,692 B2 * 1/2017 Shomali ..... H01R 13/5224
9,608,455 B2 * 3/2017 Byrne ..... H02J 5/005
9,614,338 B2 * 4/2017 Alexander ..... H01R 35/04
9,660,394 B2 * 5/2017 Zien ..... H01R 13/514
9,762,056 B1 * 9/2017 Miller ..... H02J 3/00
9,941,644 B1 * 4/2018 Liu ..... H01R 13/10
10,050,473 B2 * 8/2018 Byrne ..... H02J 50/10
10,116,094 B2 * 10/2018 Byrne ..... H01R 13/641
10,116,106 B2 * 10/2018 Byrne ..... A47C 21/003
10,122,128 B1 * 11/2018 Lu ..... H01R 13/73
10,181,675 B1 * 1/2019 Anderson ..... A47B 95/002
10,181,735 B2 * 1/2019 Byrne ..... H02J 7/0044
10,184,649 B2 * 1/2019 Chien ..... F21V 33/00
10,260,735 B2 * 4/2019 Chien ..... F21V 33/004
10,263,373 B2 * 4/2019 Byrne ..... H02J 7/00
10,312,648 B2 * 6/2019 Hsu ..... H01R 24/66
10,323,835 B1 * 6/2019 Anderson ..... F21V 33/00
10,333,284 B2 * 6/2019 Schneider ..... H02G 3/185
10,367,317 B1 * 7/2019 Rahner ..... H01R 27/02
10,381,848 B2 * 8/2019 Lin ..... H02J 7/0042

(56) References Cited

U.S. PATENT DOCUMENTS

2001/0002774 A1* 6/2001 Lee ..... H01R 25/006 307/147
2001/0046130 A1* 11/2001 Cunningham ..... A47L 5/38 362/95
2003/0092297 A1* 5/2003 Reindle ..... H01R 31/02 439/107
2003/0186582 A1* 10/2003 Laukhuf ..... H01R 25/006 439/535
2004/0075401 A1* 4/2004 Segan ..... H05B 37/029 315/291
2004/0150984 A1* 8/2004 Robertson ..... F21V 33/006 362/95
2004/0160722 A1* 8/2004 Miller, Jr. ..... H01R 13/7135 361/118
2005/0036258 A1* 2/2005 Ma ..... G05D 23/1909 361/103
2005/0105235 A1* 5/2005 Yu ..... H01R 13/713 361/118
2005/0248899 A1* 11/2005 Huang ..... H02H 11/002 361/118
2005/0286184 A1* 12/2005 Campolo ..... H01R 25/003 361/42
2006/0002055 A1* 1/2006 Germagian ..... H02J 9/00 361/600
2006/0072269 A1* 4/2006 Staples ..... G01R 19/16571 361/93.1
2006/0126243 A1* 6/2006 Cheng ..... H01R 13/6675 361/62
2006/0141855 A1* 6/2006 Bloom ..... H01R 13/447 439/501
2006/0258226 A1* 11/2006 Milan ..... H01R 13/506 439/652
2006/0274484 A1* 12/2006 Mori ..... H01R 25/003 361/601
2006/0278794 A1* 12/2006 Rast ..... A47B 21/06 248/346.01
2007/0072476 A1* 3/2007 Milan ..... H01R 25/003 439/373
2007/0247037 A1* 10/2007 Schenker ..... A47B 88/00 312/223.6
2007/0275594 A1* 11/2007 Greenberg ..... H01R 13/72 439/501
2008/0094210 A1* 4/2008 Paradiso ..... H04L 12/2827 340/540
2008/0200050 A1* 8/2008 Byrne ..... H01R 35/04 439/131
2008/0233780 A1* 9/2008 Waters ..... H01R 13/7172 439/214
2008/0248667 A1* 10/2008 Sun ..... H01R 13/7038 439/188
2009/0152944 A1* 6/2009 Baine ..... H01R 25/162 307/12
2009/0215319 A1* 8/2009 Gandhi ..... H01R 13/7038 439/654
2009/0231167 A1* 9/2009 Chen ..... H03K 17/962 341/22
2010/0044195 A1* 2/2010 Chiang ..... G06F 1/266 200/175
2010/0317223 A1* 12/2010 Byrne ..... H01R 13/514 439/540.1
2011/0089768 A1* 4/2011 Byrne ..... H01F 38/14 307/104
2011/0109211 A1* 5/2011 Kirkeby ..... A47B 81/00 312/223.6
2011/0169408 A1* 7/2011 Chen ..... F21K 9/00 315/51
2011/0177703 A1* 7/2011 Lin ..... A47B 21/06 439/131
2011/0213510 A1* 9/2011 Mozayeny ..... A61M 5/1723 700/297
2011/0215759 A1* 9/2011 Lee ..... G06F 1/266 320/115
2011/0228449 A1* 9/2011 Keebler ..... H02J 7/0055 361/622
2011/0316711 A1* 12/2011 Ho ..... G01R 31/026 340/644
2012/0009820 A1* 1/2012 Byrne ..... H02G 3/0437 439/625
2012/0028505 A1* 2/2012 Weber ..... H01R 25/003 439/638
2012/0113645 A1* 5/2012 Liao ..... H02J 7/0042 362/253
2013/0102186 A1* 4/2013 Fu ..... H01R 13/72 439/501
2014/0098445 A1* 4/2014 Hooper ..... H02H 3/16 361/42
2014/0120765 A1* 5/2014 Lombardo ..... H01R 9/2408 439/501
2014/0187079 A1* 7/2014 Zien ..... H01R 13/514 439/490
2014/0326497 A1* 11/2014 Byrne ..... H02G 3/18 174/541
2015/0076907 A1* 3/2015 Roh ..... H01R 25/003 307/38
2015/0091389 A1* 4/2015 Byrne ..... H02J 5/005 307/104
2015/0176826 A1* 6/2015 Chien ..... F21S 8/035 362/253
2015/0180185 A1* 6/2015 Shammoh ..... H01R 13/70 439/373
2015/0311649 A1* 10/2015 Horne ..... H01R 13/641 439/489
2016/0006189 A1* 1/2016 Morehead ..... H01R 13/518 439/501
2016/0070324 A1* 3/2016 Emby ..... G06F 1/266 710/110
2016/0156187 A1* 6/2016 Mozayeny ..... A61M 5/1723 307/38
2016/0218469 A1* 7/2016 Smed ..... H01R 9/2408
2016/0372962 A1* 12/2016 Byrne ..... H02J 5/005
2017/0054323 A1* 2/2017 Lo ..... H01R 13/665
2017/0104299 A1* 4/2017 Vu ..... H01R 13/7175
2017/0358893 A1* 12/2017 Wieland ..... H01R 25/003
2017/0373534 A1* 12/2017 Gelonese ..... H01R 25/003
2018/0149350 A1* 5/2018 Johnson-Gray ..... H02J 7/355
2018/0196098 A1* 7/2018 Ferguson ..... G01R 19/2509
2018/0212371 A1* 7/2018 Xu ..... H01R 13/717
2018/0316189 A1* 11/2018 Mozayeny ..... A61M 5/1723
2018/0316201 A1* 11/2018 Miller ..... H01R 13/6666

* cited by examiner

ILLUMINATED ELECTRICITY DISTRIBUTION DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of lighting including details of lighting devices, more specifically, an arrangement of circuit elements in a lighting device wherein the elements are coupling devices. (F21V23/06)

SUMMARY OF INVENTION

The illuminated electricity distribution device is an electricity distribution device. The illuminated electricity distribution device distributes AC electrical energy suitable for use with an appliance. The illuminated electricity distribution device is a lamp. The lamp generates illumination within the space around the illuminated electricity distribution device. The illuminated electricity distribution device is configured to mount on a surface including the inferior side of a horizontal surface. The illuminated electricity distribution device comprises a housing, a power distribution circuit, and a lighting circuit. The housing contains the power distribution circuit and the lighting circuit. The power distribution circuit receives electricity from an external power source and distributes the received electricity to the appliance. The external power source is selected from the group consisting of the national electric grid or an additional instantiation of the illuminated electricity distribution device. The lighting circuit generates light used to illuminate the space around the illuminated electricity distribution device. The level of light generated for illumination is adjustable.

These together with additional objects, features and advantages of the illuminated electricity distribution device will be readily apparent to those of ordinary skill in the art upon reading the following detailed description of the presently preferred, but nonetheless illustrative, embodiments when taken in conjunction with the accompanying drawings.

In this respect, before explaining the current embodiments of the illuminated electricity distribution device in detail, it is to be understood that the illuminated electricity distribution device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the illuminated electricity distribution device.

It is therefore important that the claims be regarded as including such equivalent construction insofar as they do not depart from the spirit and scope of the illuminated electricity distribution device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
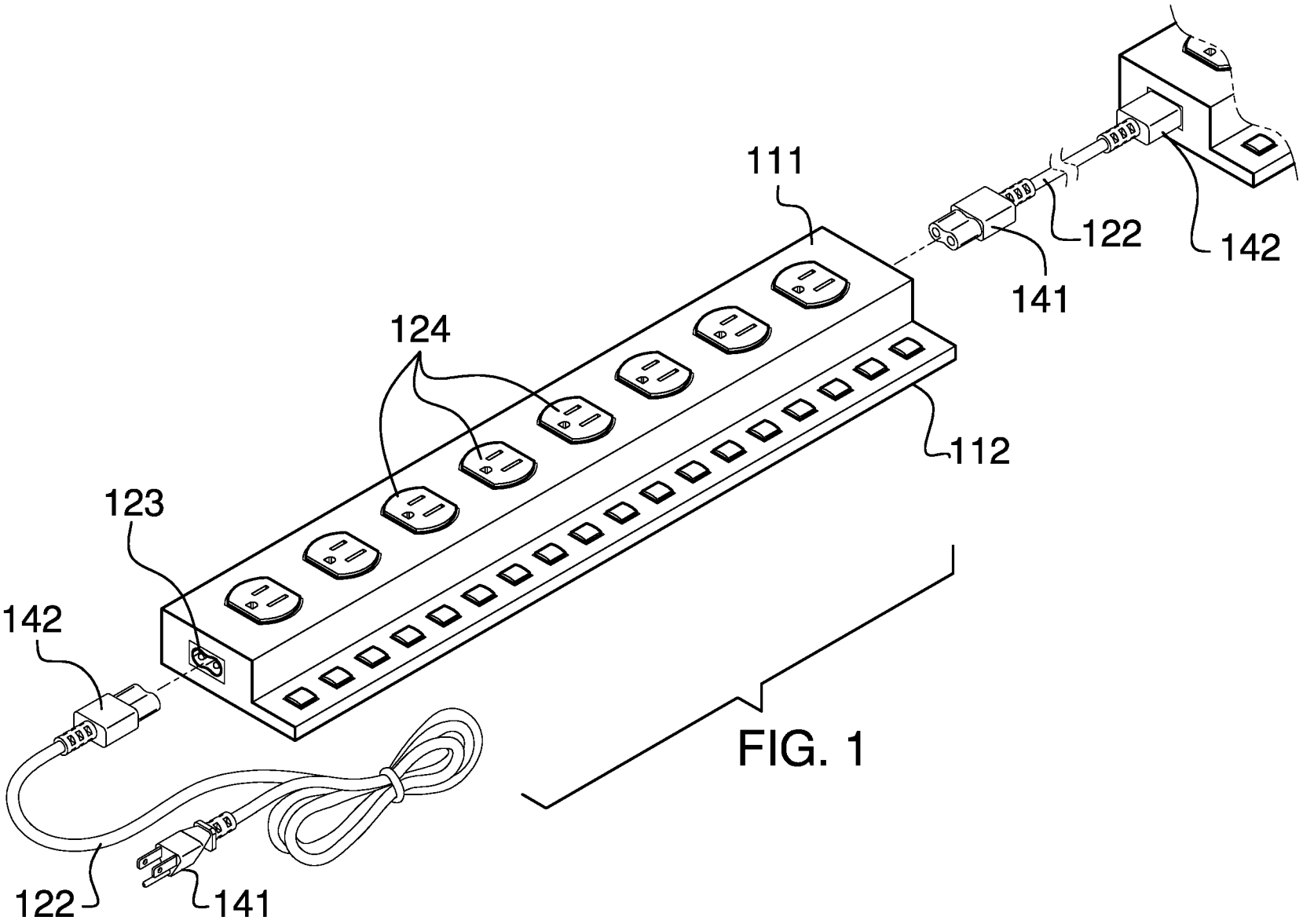
FIG. 1 is a perspective view of an embodiment of the disclosure.
Figure 2:
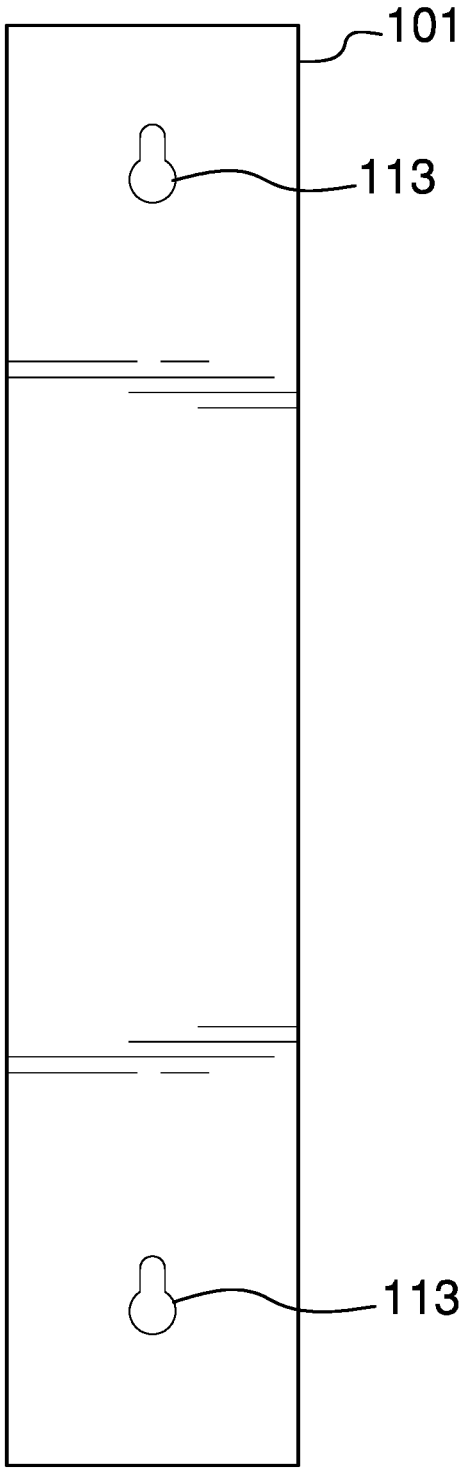
FIG. 2 is a side view of an embodiment of the disclosure.
Figure 3:
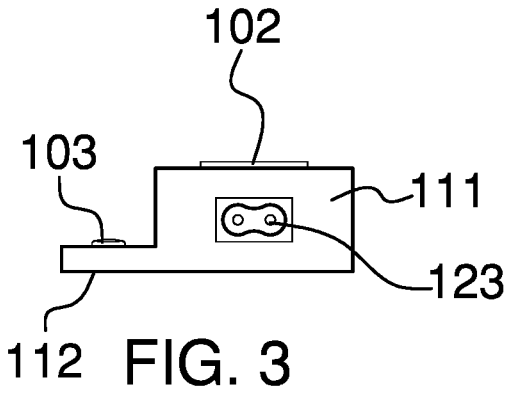
FIG. 3 is a bottom view of an embodiment of the disclosure.
Figure 4:
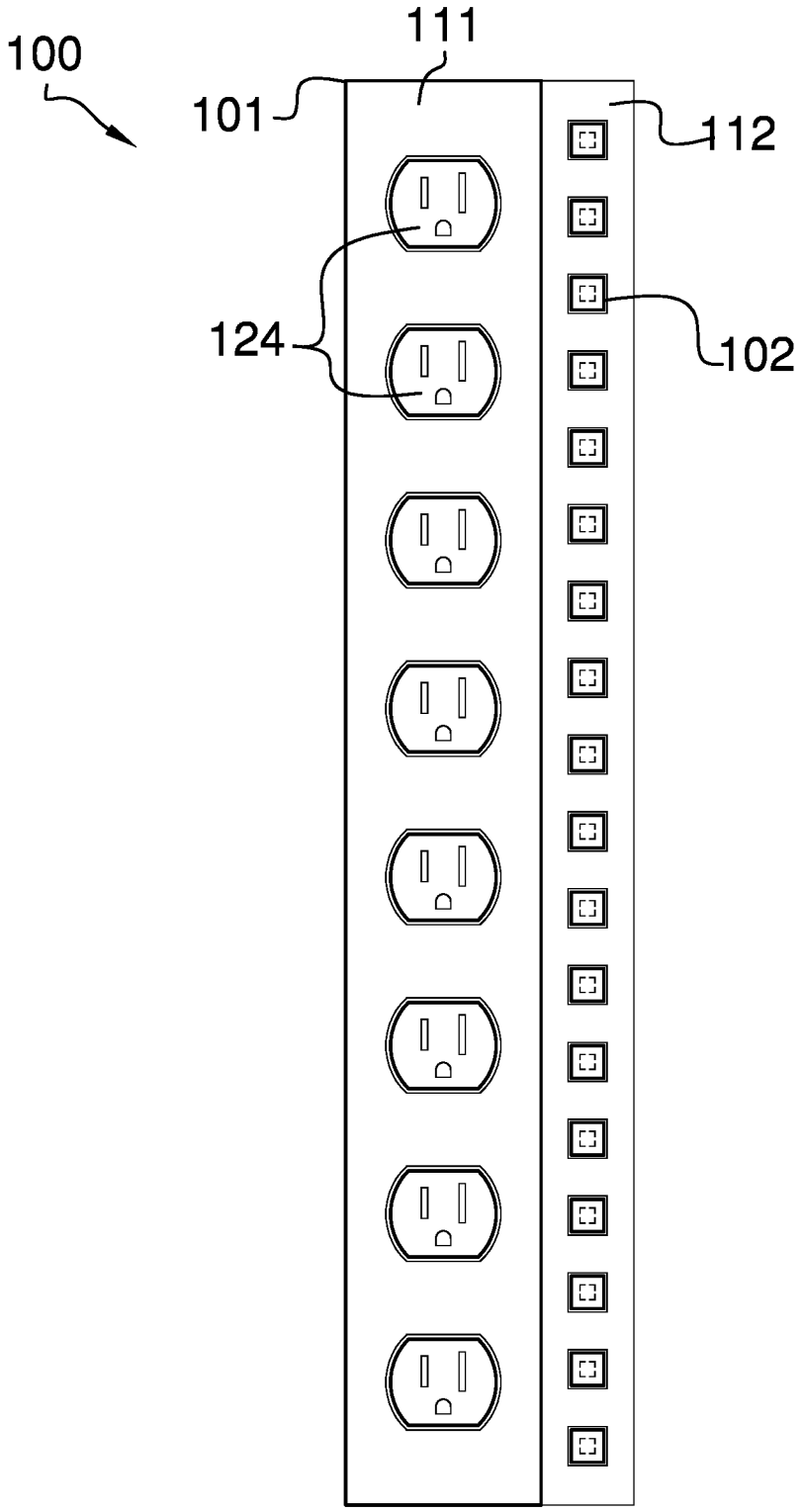
FIG. 4 is a top view of an embodiment of the disclosure.
Figure 5:
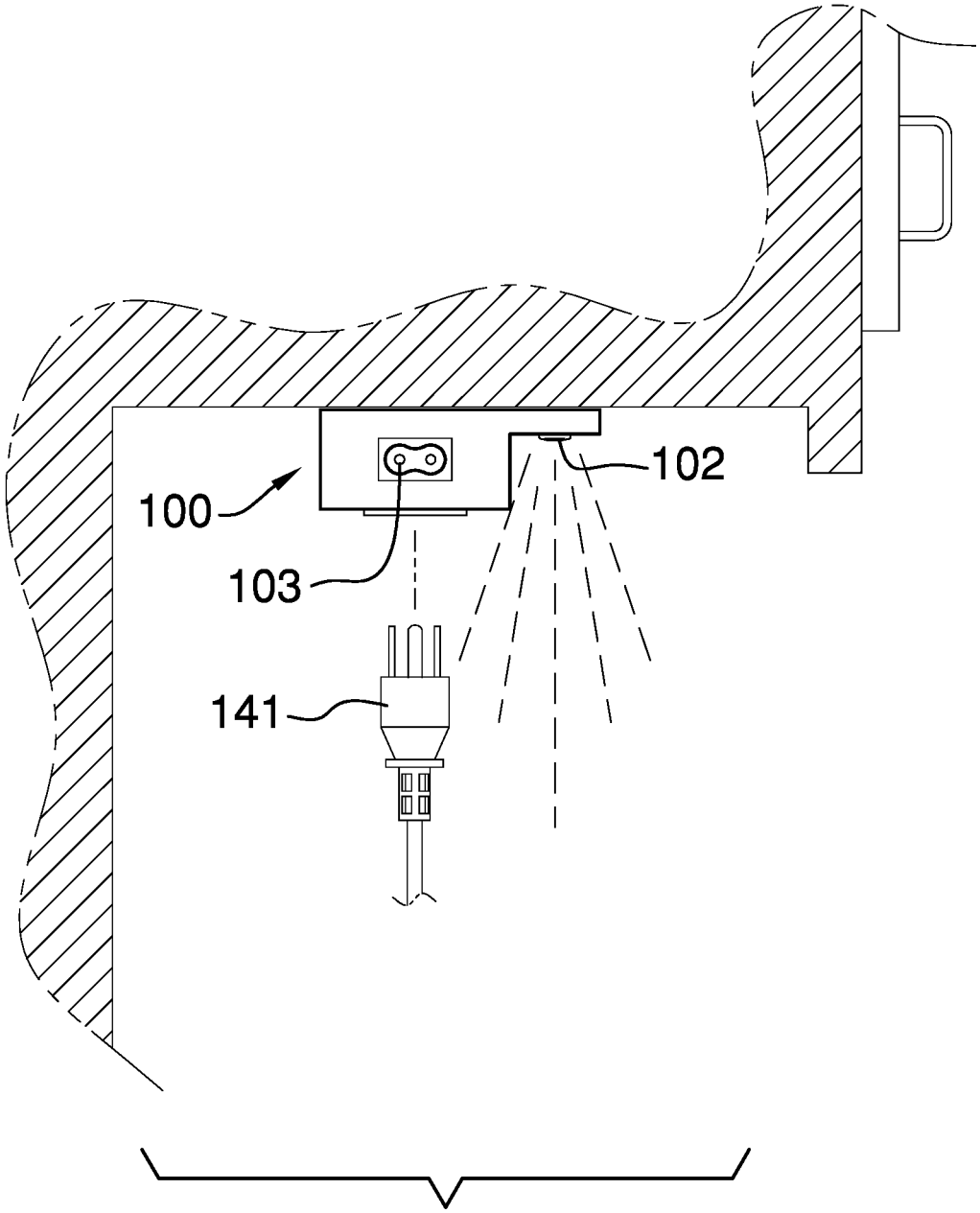
FIG. 5 is an in-use view of an embodiment of the disclosure.
Figure 6:
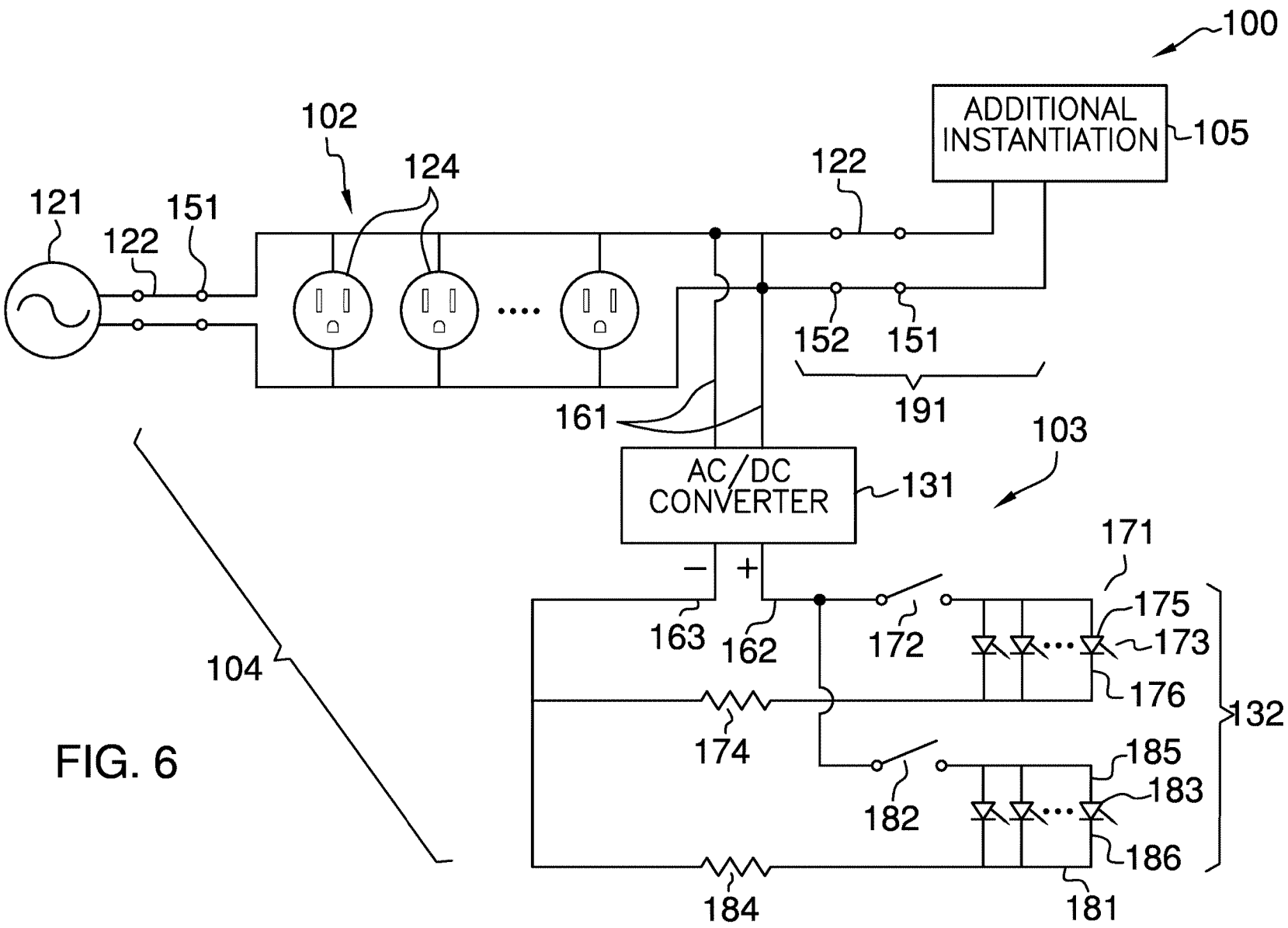
FIG. 6 is a schematic view of an embodiment of the disclosure.
Figure 7:
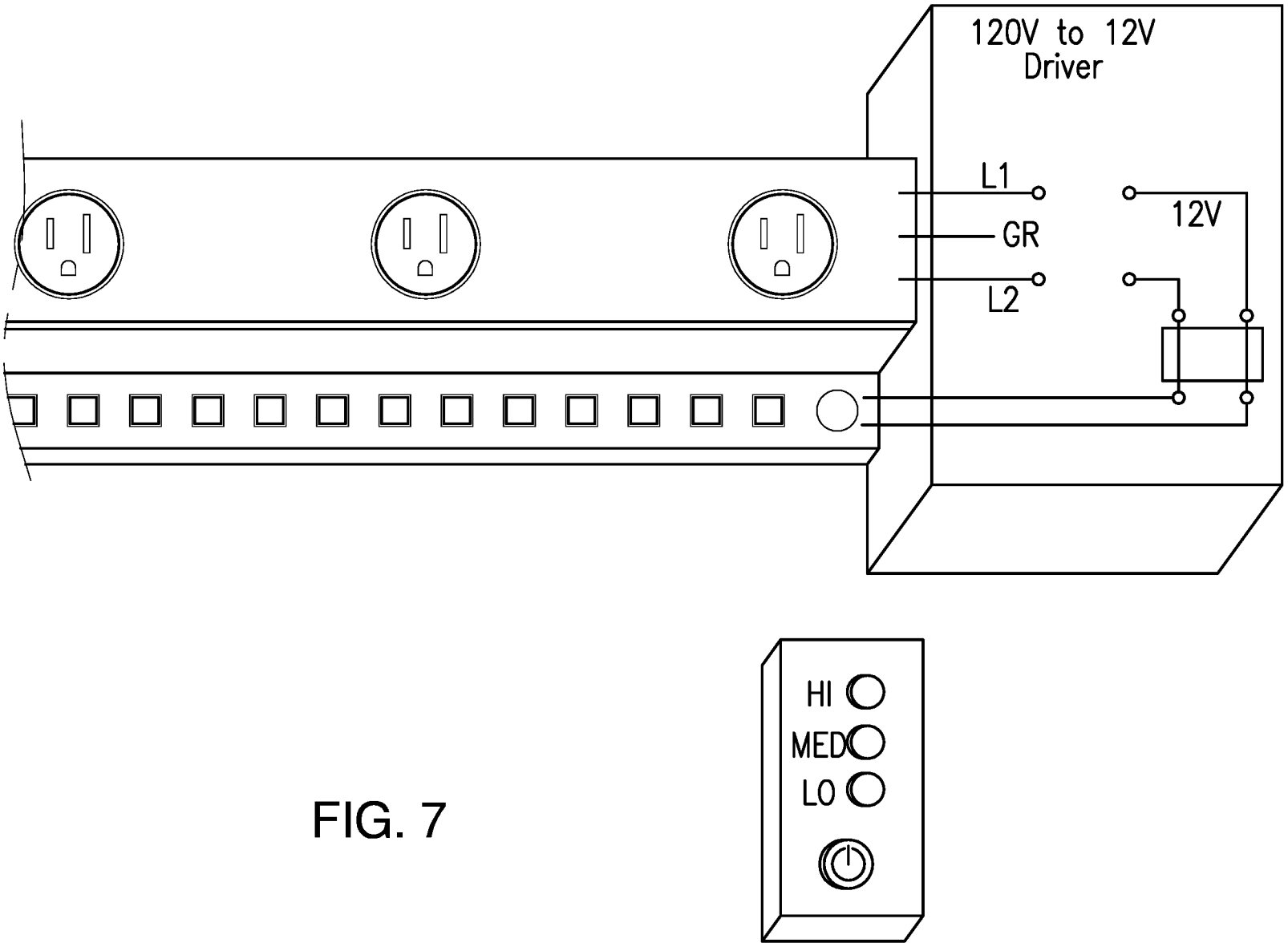
FIG. 7 is a view of an embodiment that includes a remote control feature.

Detailed reference will now be made to one or more potential embodiments of the disclosure, which are illustrated in FIGS. 1 through 7.

The illuminated electricity distribution device 100 (hereinafter invention) is an electricity distribution device. The invention 100 distributes AC electrical energy suitable for use with an appliance. The invention 100 is a lamp. The lamp generates illumination within the space around the invention 100. The invention 100 is configured to mount on a surface including the inferior side of a horizontal surface. The invention 100 comprises a housing 101, a power distribution circuit 102, and a lighting circuit 103. The housing 101 contains the power distribution circuit 102 and the lighting circuit 103. The power distribution circuit 102 receives electricity from an external power source 121 and distributes the received electricity to the appliance. The external power source 121 is selected from the group consisting of the national electric grid or an additional instantiation 105 of the invention 100. The lighting circuit 103 generates light used to illuminate the space around the invention 100. The level of light generated for illumination is adjustable.

The invention 100 further comprises an initial instantiation 104 and an additional instantiation 105. The initial instantiation 104 is a first instantiation of the invention 100. The additional instantiation 105 is a second instantiation of the invention 100. The additional instantiation 105 is identical to the initial instantiation 104. The additional instantiation 105 electrically connects to the initial instantiation 104 such that the additional instantiation 105 draws AC electrical energy from the initial instantiation 104. The additional instantiation 105 electrically connects to the initial instantiation 104 using a daisy chain configuration 191. The daisy chain configuration 191 is defined in greater detail elsewhere in this disclosure.

The housing 101 is a casing. The housing 101 contains the power distribution circuit 102 and the lighting circuit 103. The housing 101 is formed with all apertures and form factors necessary to allow the housing 101 to accommodate the use and operation of the power distribution circuit 102 and the lighting circuit 103. Methods to form a housing 101 suitable for the purposes described in this disclosure are well-known and documented in the mechanical arts. The housing 101 comprises a socket tube 111 and an LED wing 112.

The socket tube 111 is a casing. The socket tube 111 contains the power distribution circuit 102. The socket tube 111 is formed with all apertures and form factors necessary to allow the socket tube 111 to accommodate the use and operation of the power distribution circuit 102. Methods to form a socket tube 111 suitable for the purposes described in this disclosure are well-known and documented in the mechanical arts.

The socket tube 111 further comprises a plurality of keyholes 113. Each of the plurality of keyholes 113 are cavities formed within the exterior surface of the socket tube 111. The plurality of keyholes 113 attach the invention 100 to a surface by attaching the socket tube 111 to the invention 100. The keyholes contained in the plurality of keyholes 113 are defined in greater detail elsewhere in this disclosure.

The LED wing 112 is a casing. The LED wing 112 contains the lighting circuit 103. The LED wing 112 is formed with all apertures and form factors necessary to allow the LED wing 112 to accommodate the use and operation of the lighting circuit 103. Methods to form an LED wing 112 suitable for the purposes described in this disclosure are well-known and documented in the mechanical arts.

The LED wing 112 attaches to the exterior surface of the socket tube 111.

The power distribution circuit 102 is an electrical circuit. The power distribution circuit 102 draws AC electrical energy from the external power source 121. The power distribution circuit 102 distributes the received AC electrical energy to each of the NEMA 5-15 electrical sockets contained in the plurality of NEMA 5-15 electrical sockets 124. Each NEMA 5-15 electrical socket selected from the plurality of NEMA 5-15 electrical sockets 124 of the power distribution circuit 102 provides electrical energy for an appliance. The power distribution circuit 102 distributes the received AC electrical energy to the lighting circuit 103. The power distribution circuit 102 comprises an external power source 121, an electrical cable 122, a plurality of terminal ports 123, and the plurality of NEMA 5-15 electrical sockets 124.

The external power source 121 is an externally provisioned source of AC electrical energy used to power the invention 100. This disclosure assumes that an initial instantiation 104 of the disclosure uses the national electric grid as the external power source 121. The invention 100 is configured such that an additional instantiation 105 of the disclosure can further use the initial instantiation 104 as the external power source 121. The external power source 121 is defined in greater detail elsewhere in this disclosure.

The electrical cable 122 is an electrically conductive device that transports electricity from the external power source 121 to a terminal port selected from the plurality of terminal ports 123. The electrical cable 122 is defined in greater detail elsewhere in this disclosure. The electrical cable 122 comprises a first terminal plug 141 and a second terminal plug 142.

The first terminal plug 141 is a standardized electrical termination. The first terminal plug 141 electrically connects the electrical cable 122 to the external power supply 121. The second terminal plug 142 is a standardized electrical termination. The second terminal plug 142 electrically connects the electrical cable 122 to a terminal port selected from the plurality of terminal ports 123.

Each of the plurality of terminal ports 123 is a standardized electrical termination. Each of the plurality of terminal ports 123 performs a function selected from the group consisting of: a) receiving electrical energy from an external power source 121; or, b) serving as the external power source 121 for an additional instantiation 105 of the disclosure. The plurality of terminal ports 123 comprises a first terminal port 151 and a second terminal port 152.

The first terminal port 151 is a standardized electrical termination. The first terminal port 151 receives second terminal plug 142 of the electrical cable 122 such that the first terminal port 151 electrically connects to the external power source 121. The second terminal port 152 is a standardized electrical termination. The second terminal port 152 receives first terminal plug 141 of the electrical cable 122 of an additional instantiation 105 of the disclosure such that the second terminal port 152 electrically connects to the first terminal port 151 of the additional instantiation 105 through the electrical cable 122 of the additional instantiation 105.

Each of the plurality of NEMA 5-15 electrical sockets 124 is an electrical socket. Each of the plurality of NEMA 5-15 electrical sockets 124 forms an electrical connection that transfers AC electrical energy from the external power source 121 to an appliance. The use of a NEMA 5-15 electrical socket selected from the plurality of NEMA 5-15 electrical sockets 124 is well-known and documented in the electrical arts. The NEMA 5-15 electrical socket is defined in greater detail elsewhere in this disclosure.

The lighting circuit 103 is an electrical circuit. The lighting circuit 103 generates light used to illuminate the space around the invention 100. The lighting circuit 103 draws AC electrical energy from the power distribution circuit 102 for this purpose. The level of light generated by the lighting circuit 103 is adjustable. The lighting circuit 103 comprises an AC/DC converter 131 and one or more light banks 132.

The AC/DC converter 131 is an electrical circuit. The AC/DC converter 131 draws AC electrical energy from the first terminal port 151 of the power distribution circuit 102 and converts the AC electrical energy into DC electrical energy. The DC electrical energy generated by the AC/DC converter 131 powers the balance of the lighting circuit 103. The AC/DC converter 131 is well-known and documented in the electrical arts. The AC/DC converter 131 is defined in greater detail elsewhere in this disclosure. The AC/DC converter 131 further comprises a power tap 161, a positive terminal 162, and a negative terminal 163.

The power tap 161 forms the electrical connection between the first terminal port 151 and the AC/DC converter 131 such that the AC/DC converter 131 draws electricity from the external power source 121. Methods to design and use a power tap 161 are well-known and documented in the electrical arts. The positive terminal 162 is the first of two electrical connections to the output of DC electrical energy from the AC/DC converter 131. The negative terminal 163 is the second of two electrical connections to the output of DC electrical energy from the AC/DC converter 131.

Each of the one or more light banks 132 is a lamp used to illuminate the space around the invention 100. The illumination of each of the one or more light banks 132 operates independently. The illumination level generated by the one or more light banks 132 is a function of the operating status of each individual light bank selected from the one or more light banks 132. The one or more light banks 132 comprises a first light bank 171 and a second light bank 181.

The first light bank 171 is a light bank selected from the one or more light banks 132. The first light bank 171 comprises a first switch 172, a first plurality of LEDs 173, and a first limit resistor 174. Each of the first plurality of LEDs 173 is further defined with a first anode 175 and a first cathode 176.

The first switch 172 is a commercially available maintained switch. The first switch 172 controls the flow of electricity through the first plurality of LEDs 173 and the first limit resistor 174. Each of the first plurality of LEDs 173 is a two-terminal semiconducting device that generates light. The first plurality of LEDs 173 generate light used to illuminate the space around the invention 100. The first plurality of LEDs 173 are wired in parallel. The first limit resistor 174 is an electrical device used to limit the flow of electricity through the first plurality of LEDs 173. The first anode 175 is defined in greater detail elsewhere in this disclosure. The first cathode 176 is defined in greater detail elsewhere in this disclosure.

The second light bank 181 is a light bank selected from the one or more light banks 132. The second light bank 181 comprises a second switch 182, a second plurality of LEDs 183, and a second limit resistor 184. Each of the second plurality of LEDs 183 is further defined with a second anode 185 and a second cathode 186.

The second switch 182 is a commercially available maintained switch. The second switch 182 controls the flow of electricity through the second plurality of LEDs 183 and the second limit resistor 184. Each of the second plurality of LEDs 183 is a two-terminal semiconducting device that generates light. The second plurality of LEDs 183 generate light used to illuminate the space around the invention 100. The second plurality of LEDs 183 are wired in parallel. The second limit resistor 184 is an electrical device used to limit the flow of electricity through the second plurality of LEDs 183. The second anode 185 is defined in greater detail elsewhere in this disclosure. The second cathode 186 is defined in greater detail elsewhere in this disclosure.

The following three paragraphs describe the assembly of the power distribution circuit 102 and the lighting circuit 103.

The first terminal plug 141 of the electrical cable 122 electrically connects to the external power source 121. The second terminal plug 142 of the electrical cable 122 electrically connects to the first terminal port 151 of the plurality of terminal ports 123. The first terminal port 151 of the plurality of terminal ports 123 electrically connects to the second terminal port 152 of the plurality of terminal ports 123. The first terminal port 151 of the plurality of terminal ports 123 electrically connects to each NEMA 5-15 electrical socket contained in the plurality of NEMA 5-15 electrical sockets 124. The power tap 161 of the AC/DC converter 131 electrically connects to the first terminal port 151 of the plurality of terminal ports 123.

The positive terminal 162 of the power tap 161 electrically connects to the first switch 172 of the first light bank 171. The first switch 172 forms a series connection between the positive terminal 162 and the first anode 175 of each of the first plurality of LEDs 173. The first cathode 176 of each of the first plurality of LEDs 173 electrically connects to the first limit resistor 174. The first limit resistor 174 forms a series connection between the first cathode 176 of each of the first plurality of LEDs 173 and the negative terminal 163 of the AC/DC converter 131.

The positive terminal 162 of the power tap 161 electrically connects to the second switch 182 of the second light bank 181. The second switch 182 forms a series connection between the positive terminal 162 and the second anode 185 of each of the second plurality of LEDs 183. The second cathode 186 of each of the second plurality of LEDs 183 electrically connects to the second limit resistor 184. The second limit resistor 184 forms a series connection between the second cathode 186 of each of the second plurality of LEDs 183 and the negative terminal 163 of the AC/DC converter 131.

The invention 100 is designed as a modular structure. The following paragraph describes the daisy chain configuration 191 used to connect an initial instantiation 104 of the invention 100 to an additional instantiation 105 of the invention 100.

An additional instantiation 105 of the invention 100 electrically connects to the initial instantiation 104 of the invention 100 using a daisy chain configuration 191. Specifically, the invention 100 allows for the additional instantiation 105 to use the initial instantiation 104 as the external power source 121 by electrically connecting the first terminal plug 141 of the electrical cable 122 of the additional instantiation 105 into the second terminal port 152 of the plurality of terminal ports 123 of the initial instantiation 104. Once the daisy chain configuration 191 is completed, the additional instantiation 105 will operate in a manner identical to the initial instantiation 104.

The following definitions were used in this disclosure:

AC: As used in this disclosure, AC is an acronym for alternating current.

AC/DC Converter: As used in this disclosure, an AC/DC converter is an electrical device that converts an AC voltage into a regulated DC voltage by rectifying and regulating the AC voltage. Method to design and build AC/DC converters are well-known in the electrical arts. The AC/DC converter is further defined with a positive terminal, a negative terminal and a power input.

Anodes and Cathodes: As used in this disclosure, an anode and a cathode are the connecting terminals of an electrical circuit element or device. Technically, the cathode is the terminal through which the physical electrons flow into the device. The anode is the terminal through which the physical electrons flow out of the device. As a practical matter, the anode refers to: 1) the positive terminal of a power consuming electrical circuit element; 2) the negative terminal of a discharging battery or an electrical power source; and, 3) the positive terminal of a charging battery. As a further practical matter, the cathode refers to: 1) the negative terminal of a power consuming electrical circuit element; 2) the positive terminal of a discharging battery or an electrical power source; and, 3) the negative terminal of a charging battery.

Appliance: As used in this disclosure, an appliance is a device attached to the invention for the purpose of receiving power. While cellular phones are specifically referenced in the title of this specification, the invention is not limited to cell phones and can be used with any electrically compatible appliance including, but not limited to, cellular phones, smart phones, personal data assistants, tablets, digital or analog music players, GPS navigation systems, recording devices, and computers.

Cable: As used in this disclosure, a cable is a collection of insulated wires covered by a protective casing used for transmitting electricity or telecommunication signals.

Daisy Chain: As used in this disclosure, daisy chain is a term that describes a series of objects that are linked together in a linear fashion. When referring to an electrical circuit, a daisy chain refers to a collection of electrical circuits interconnected using a series circuit.

DC: As used in this disclosure, DC is an acronym for direct current.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. Specifically, the sum of the surface areas of two ends of the prism-shaped object that forms the disk is greater than the surface area of lateral face of the prism-shaped object that forms the disk. In this disclosure, the ends of the prism-shaped structure that forms the disk are referred to as the faces of the disk.

Extension Structure: As used in this disclosure, an extension structure is an inert physical structure that is used to extend the span of the distance between any two objects.

External Power Source: As used in this disclosure, an external power source is a source of the energy that is externally provided to enable the operation of the present disclosure. Examples of external power sources include, but are not limited to, electrical power sources and compressed air sources.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Housing: As used in this disclosure, a housing is a rigid casing that encloses and protects one or more devices.

Inferior: As used in this disclosure, the term inferior refers to a directional reference that is parallel to and in the same direction as the force of gravity when an object is positioned or used normally.

Instantiation: As used in this disclosure, an instantiation refers to a specific physical object or process that is created using a specification.

Keyhole: As used in this disclosure, a keyhole refers to an aperture formed through a surface. The keyhole has a characteristic shape of a rectangle with a circle located at the narrow end of the rectangle. The diameter of the circle is greater than the span of the narrow end of the rectangle. The keyhole is used to secure an object to the surface. Specifically, the object has a disk shape mounted on an extension structure. The diameter of the disk is less than the diameter of the circle such that the disk will insert through the circle. The diameter of the disk is greater than the span of the narrow end of the rectangle such when the disk is slid underneath the rectangle the disk will not pass through the rectangle thereby securing the object to the surface. The size of the extension structure is selected such that the extension will slide into the rectangle.

Lamp: As used in this disclosure, a lamp is an electrical device that generates (typically visible) electromagnetic radiation.

LED: As used in this disclosure, an LED is an acronym for a light emitting diode. A light emitting diode is a diode that is also a light source.

Light: As used in this disclosure, light refers to electromagnetic radiation that illuminates an area.

Limit Resistor: As used in this disclosure, a limit resistor is an electrical resistor that is used to limit the flow of electric current through an electrical circuit.

Maintained Switch: A used in this disclosure, a maintained switch is a switch that maintains the position that was set in the most recent switch actuation. A maintained switch works in an opposite manner to a momentary switch.

Mount: As used in this disclosure, a mount is a mechanical structure that attaches or incorporates an object into a load path.

National Electric Grid: As used in this disclosure, the national electric grid is a synchronized and highly interconnected electrical network that distributes energy in the form of electric power from a plurality of generating stations to consumers of electricity. The national electric grid is a commercially available source of AC electrical power. The national electric grid is regulated by an appropriate authority. The national electric grid sells electrical power for use by an electrical load. The national electric grid invoices for electrical power based on the total energy consumed by the electrical load. The national electric grid measures the energy consumption of an electrical load with an electrical meter.

NEMA: As used in this disclosure, NEMA is an acronym for National Electric Manufacturers Association. NEMA is a manufacturer's association known for publishing widely accepted technical standards regarding the performance of electrical power distribution equipment.

NEMA 5-15 Electrical Socket: As used in this disclosure, the NEMA 5-15 electrical socket is a port designed to provide electric power drawn from the National Electric Grid. The NEMA 5-15 electrical socket is commonly used to deliver electrical power to electric devices in residential, office, and light industrial settings. The typical NEMA5-15 electrical socket comprises a plurality of electric ports from which electric power is drawn. The position of each of the plurality of electric ports is placed in a standardized position. The typical NEMA5-15 electrical socket further comprises a plate hole which is a standardized hole located in a standardized position within the NEMA 5-15 electrical socket that that is designed to receive a bolt that is used to attach a faceplate to the NEMA 5-15 electrical socket. The NEMA 5-15 electrical socket is also commonly referred to as an electrical outlet.

NEMA 5-15P Electrical Plug: As used in this disclosure, the NEMA 5-15P Electrical Plug is a plug that is designed to insert into a NEMA 5-15 Electrical Socket for the purpose of delivering electrical power to electrical devices. The NEMA 5-15P Electrical Plug is a three blade plug that is commonly found within residential and office environments within the United States.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Radial: As used in this disclosure, the term radial refers to a direction that: 1) is perpendicular to an identified central axis; or, 2) projects away from a center point.

Resistor: As used in this disclosure, a resistor is a well-known and commonly available electrical device that inhibits the flow of electricity through an electric circuit. Within an electric circuit processing alternating currents, the resistor will not affect the phase of the alternating current. A current flowing through a resistor will create a voltage across the terminals of the resistor.

Superior: As used in this disclosure, the term superior refers to a directional reference that is parallel to and in the opposite direction of the force of gravity when an object is positioned or used normally.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventors claim:

1. A modular electricity distribution device comprising:

a housing, a power distribution circuit, and a lighting circuit;

wherein the housing contains the power distribution circuit and the lighting circuit;

wherein the power distribution circuit and the lighting circuit are electrically interconnected;

wherein the modular electricity distribution device is a lamp;

wherein the lamp generates illumination within the space around the modular electricity distribution device;

wherein the lighting circuit forms the lamp;

wherein the modular electricity distribution device distributes AC electrical energy;

wherein the modular electricity distribution device is configured to mount on a surface;

wherein the power distribution circuit receives electricity from an external power source;

wherein the external power source is selected from the group consisting of the national electric grid or an additional instantiation of the modular electricity distribution device;

wherein the housing is a casing;

wherein the housing contains the power distribution circuit and the lighting circuit;

wherein the housing comprises a socket tube and an LED wing;

wherein the LED wing attaches to the socket tube;

wherein the power distribution circuit comprises an external power source, an electrical cable, a plurality of terminal ports, and a plurality of NEMA 5-15 electrical sockets;

wherein the external power source, the electrical cable, the plurality of terminal ports, and the plurality of NEMA 5-15 electrical sockets are electrically interconnected;

wherein the power distribution circuit draws AC electrical energy from the external power source;

wherein the power distribution circuit distributes the received AC electrical energy to the plurality of NEMA 5-15 electrical sockets;

wherein the power distribution circuit distributes the received AC electrical energy to the lighting circuit;

wherein the electrical cable comprises a first terminal plug and a second terminal plug;

wherein the first terminal plug is a standardized electrical termination;

wherein the second terminal plug is a standardized electrical termination;

wherein the first terminal plug electrically connects the electrical cable to the external power supply;

wherein the second terminal plug electrically connects the electrical cable to a terminal port selected from the plurality of terminal ports;

wherein the plurality of terminal ports comprises a first terminal port and a second terminal port;

wherein the first terminal port is a standardized electrical termination;

wherein the second terminal port is a standardized electrical termination;

wherein the first terminal port receives the second terminal plug of the electrical cable such that the first terminal port electrically connects to the external power source;

wherein the AC/DC converter further comprises a power tap, a positive terminal, and a negative terminal;

wherein the power tap forms the electrical connection between the first terminal port and the AC/DC converter such that the AC/DC converter draws electricity from the external power source;

wherein the positive terminal is the first of two electrical connections to the output of DC electrical energy from the AC/DC converter;

wherein the negative terminal is the second of two electrical connections to the output of DC electrical energy from the AC/DC converter;

wherein the one or more light banks comprises a first light bank;

wherein the first light bank comprises a first switch, a first plurality of LEDs, and a first limit resistor;

wherein the first switch, the first plurality of LEDs, and the first limit resistor are electrically interconnected;

wherein each of the first plurality of LEDs is further defined with a first anode and a first cathode;

wherein the first terminal plug of the electrical cable electrically connects to the external power source;

wherein the second terminal plug of the electrical cable electrically connects to the first terminal port of the plurality of terminal ports;

wherein the first terminal port of the plurality of terminal ports electrically connects to the second terminal port of the plurality of terminal ports;

wherein the first terminal port of the plurality of terminal ports electrically connects to each NEMA 5-15 electrical socket contained in the plurality of NEMA 5-15 electrical sockets;

wherein the power tap of the AC/DC converter electrically connects to the first terminal port of the plurality of terminal ports;

wherein the positive terminal of the power tap electrically connects to the first switch of the first light bank;

wherein the first switch forms a series connection between the positive terminal and the first anode of each of the first plurality of LEDs;

wherein the first cathode of each of the first plurality of LEDs electrically connects to the first limit resistor;

wherein the first limit resistor forms a series connection between the first cathode of each of the first plurality of LEDs and the negative terminal of the AC/DC converter;

wherein the positive terminal of the power tap electrically connects to the second switch of the second light bank;

wherein the second switch forms a series connection between the positive terminal and the second anode of each of the second plurality of LEDs;

wherein the second cathode of each of the second plurality of LEDs electrically connects to the second limit resistor;

wherein the second limit resistor forms a series connection between the second cathode of each of the second plurality of LEDs and the negative terminal of the AC/DC converter.

2. The modular electricity distribution device according to claim 1 wherein the socket tube is a casing;

wherein the socket tube contains the power distribution circuit;

wherein the socket tube further comprises a plurality of keyholes;

wherein each of the plurality of keyholes are cavities formed within the exterior surface of the socket tube;

wherein the plurality of keyholes attach the modular electricity distribution device to a surface by attaching the socket tube to the modular electricity distribution device;

wherein the LED wing is a casing;

wherein the LED wing attaches to the exterior surface of the socket tube.

3. The modular electricity distribution device according to claim 2 wherein the power distribution circuit is an electrical circuit;

wherein the lighting circuit is an electrical circuit;

wherein the lighting circuit draws AC electrical energy from the power distribution circuit;

wherein the level of light generated by the lighting circuit is adjustable.

4. The modular electricity distribution device according to claim 3 wherein the lighting circuit comprises an AC/DC converter and one or more light banks;

wherein the AC/DC converter and the one or more light banks are electrically interconnected.

5. The modular electricity distribution device according to claim 4 wherein the electrical cable is an electrically conductive device;

wherein the electrical cable transports electricity from the external power source to a terminal port selected from the plurality of terminal ports.

6. The modular electricity distribution device according to claim 5 wherein each of the plurality of terminal ports is standardized electrical termination;

wherein each of the plurality of terminal ports performs a function selected from the group consisting of: a) receiving electrical energy from an external power source; and, b) serving as the external power source for an additional instantiation of the modular electricity distribution device.

7. The modular electricity distribution device according to claim 6 wherein each of the plurality of NEMA 5-15 electrical sockets is an electrical socket;

wherein each of the plurality of NEMA 5-15 electrical sockets forms an electrical connection that transfers AC electrical energy from the external power source to an electrical device.

8. The modular electricity distribution device according to claim 7 wherein the AC/DC converter is an electrical circuit;

wherein the AC/DC converter draws AC electrical energy from the first terminal port of the power distribution circuit;

wherein the AC/DC converter converts the AC electrical energy received from the first terminal port into DC electrical energy;

wherein the DC electrical energy generated by the AC/DC converter powers the balance of the lighting circuit.

9. The modular electricity distribution device according to claim 8 wherein each of the one or more light banks is a lamp used to illuminate the space around the modular electricity distribution device;

wherein the illumination of each of the one or more light banks operates independently;

wherein the illumination level generated by the one or more light banks is a function of the operating status of each individual light bank selected from the one or more light banks.

10. The modular electricity distribution device according to claim 9 wherein the first switch is a maintained switch;

wherein the first switch controls the flow of electricity through the first plurality of LEDs and the first limit resistor;

wherein each of the first plurality of LEDs is a two-terminal semiconducting device that generates light;

wherein the first plurality of LEDs are wired in parallel;

wherein the first limit resistor is an electrical device used to limit the flow of electricity through the first plurality of LEDs.

11. The modular electricity distribution device according to claim 10 wherein the one or more light banks further comprises a second light bank;

wherein the second light bank comprises a second switch, a second plurality of LEDs, and a second limit resistor;

wherein the second switch, the second plurality of LEDs, and the second limit resistor are electrically interconnected;

wherein each of the second plurality of LEDs is further defined with a second anode and a second cathode.

12. The modular electricity distribution device according to claim 11 wherein the second switch is a maintained switch;

wherein the second switch controls the flow of electricity through the second plurality of LEDs and the second limit resistor;

wherein each of the second plurality of LEDs is a two-terminal semiconducting device that generates light;

wherein the second plurality of LEDs are wired in parallel;

wherein the second limit resistor is an electrical device used to limit the flow of electricity through the second plurality of LEDs.

13. The modular electricity distribution device according to claim 12 wherein the modular electricity distribution device further comprises an initial instantiation and an additional instantiation;

wherein the initial instantiation is a first instantiation of the modular electricity distribution device;

wherein the additional instantiation is a second instantiation of the modular electricity distribution device;

wherein the additional instantiation is identical to the initial instantiation;

wherein the additional instantiation of the modular electricity distribution device electrically connects to the initial instantiation of the modular electricity distribution device using a daisy chain configuration;

wherein the modular electricity distribution device allows for the additional instantiation to use the initial instantiation as the external power source by electrically connecting the first terminal plug of the electrical cable of the additional instantiation into the second terminal port of the plurality of terminal ports of the initial instantiation.

* * * * *